United States Patent [19]

Svaty

[11] 4,295,500

[45] Oct. 20, 1981

[54] METHOD OF AND A DEVICE FOR FORMING AN ADDITIONAL STREAM OF AIR IN A GUIDE COMB OF AN AIR JET LOOM

[75] Inventor: Vladimir Svaty, Liberec, Czechoslovakia

[73] Assignee: Zbrojovka Vsetin, Vsetin, Czechoslovakia

[21] Appl. No.: 104,393

[22] Filed: Dec. 17, 1979

[51] Int. Cl.[3] ..... D03D 47/30

[52] U.S. Cl. ..... 139/435

[58] Field of Search ..... 139/435, 188 R, 190

[56] References Cited

U.S. PATENT DOCUMENTS

| | | | |
|---|---|---|---|
| 3,958,609 | 5/1976 | Zollinger et al. | 139/435 |
| 4,031,926 | 6/1977 | Zollinger et al. | 139/435 |
| 4,183,382 | 1/1980 | Scheffel | 139/435 |
| 4,212,330 | 7/1980 | Donk et al. | 139/435 |

*Primary Examiner*—Henry Jaudon

[57] ABSTRACT

An improved air jet loom having a guide comb and a reed wherein an auxiliary air stream is directed through the guide comb substantially along the longitudinal axis thereof. The device and method include nozzle means directing a jet of air through the reed and transversely into the comb and air jet stream deflecting means directing the transverse air stream substantially along the longitudinal axis of the comb to supplement thereby the main air stream through the guide comb.

2 Claims, 3 Drawing Figures

METHOD OF AND A DEVICE FOR FORMING AN ADDITIONAL STREAM OF AIR IN A GUIDE COMB OF AN AIR JET LOOM

BACKGROUND OF THE INVENTION

The present invention relates to a method of and a device for forming an additional stream of air in the guiding comb of an air jet weaving loop for supporting the weft thread during its insertion into an air jet loom.

For air jet looms having a reed space larger than 200 cm there is used an active guide comb also called an active confusor, i.e. the guide comb is equipped with a device for forming an additional stream of air. Such a device for forming an additional stream of air is generally equipped with a system of additional timed nozzles, which are mounted at predetermined distances along the whole length of the guide comb and support the main stream of air thus carrying the weft thread through the opened shed. These additional timed nozzles are usually located in a plurality of special lamellas disposed in the guide comb, pressurized air is supplied through the air vents formed in these lamellas.

The disadvantage of such known arrangements for forming the additional stream of air lies especially in the necessity for making the nozzle diameters and air vents formed by the lamellas very small. Consequently, the manufacture of these parts is very laborious and too costly. Last but not least, there exists the problem that such an arrangement of nozzles is sensitive to contamination, as even small particles of impurities can disturb the correct function of the additional nozzles. From the point of view of economics, the air consumption is also costly. Moreover, the resistance of the tubing to air conductance is high and the air pressure losses are therefore considerable.

SUMMARY OF THE INVENTION

The object of the present invention is to overcome the above-mentioned disadvantages of the prior art.

This problem is solved by the method according to the present invention, which is characterized by an additional air stream, which is supplied through the reed into the guide comb, this additional air stream being directed into the direction of weft thread insertion.

The device for carrying out the afore-described method consists substantially of a distribution tube which is located between the reed and harness; the distribution tube is provided with at least one nozzle the slotted orifice of which is directed towards the effective directing surface, formed on the rear part of the lamella, which has a shape resembling a turbine guide vane.

The advantages of the device according to the present invention are considerable. First, it is not necessary to supply air by elastic hoses from the sley up to the additional nozzles, which were used in former arrangements. A further advantage resides in that it is now possible to adequately dimension the distribution tube, as well as the nozzles, because it is not necessary to provide an excessively high air pressure for acceleration of the air stream. Thus it is possible to use simply a more efficient blower as a source of pressurized air.

Another advantage lies in that a considerable amount of air passes through the nozzles, so that there is no danger of clogging the nozzles.

BRIEF DESCRIPTION OF THE DRAWINGS

The invention is further set forth in the following detailed description taken in conjunction with the appended drawings, in which.

DETAILED DESCRIPTION

Figure 1:
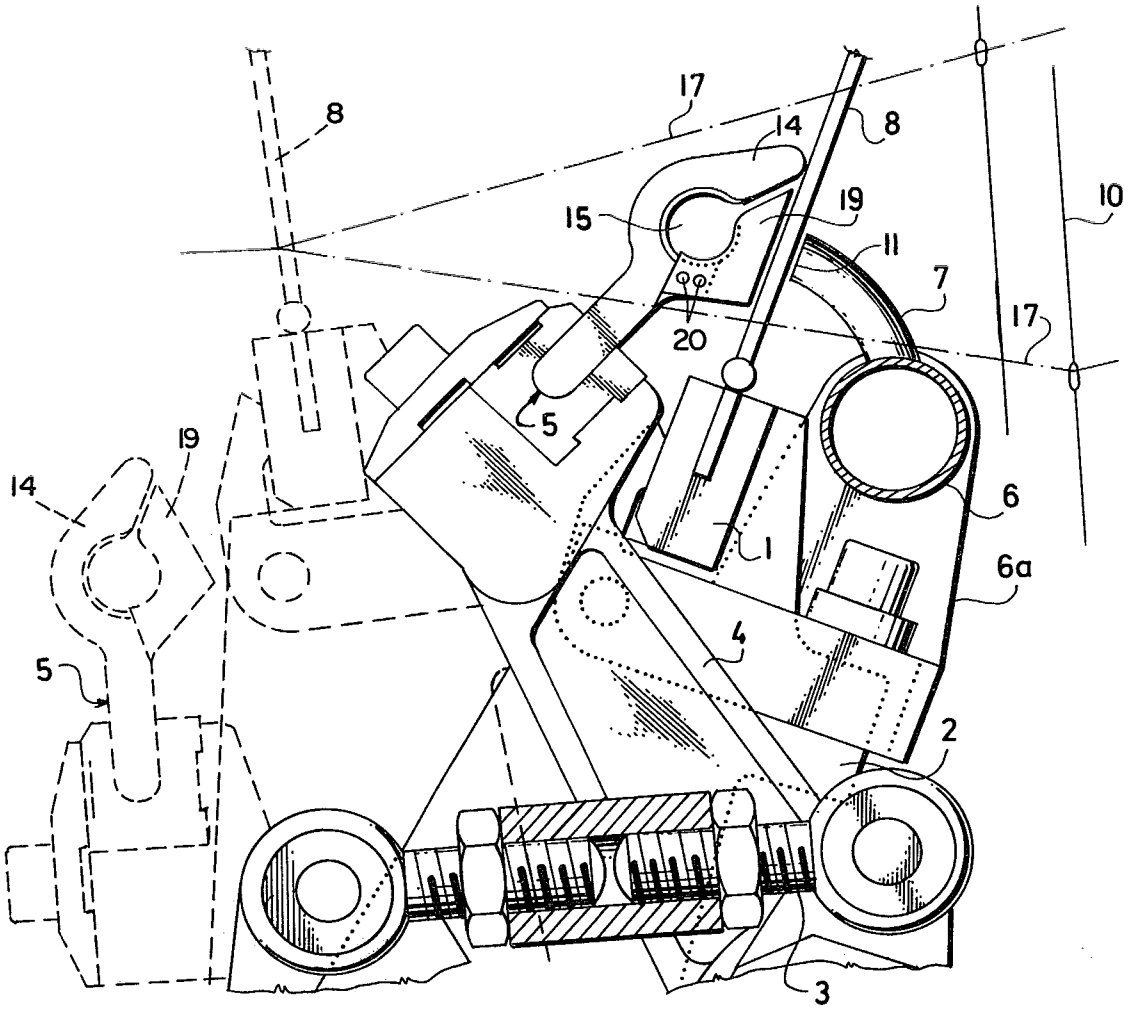
FIG. 1 is a side elevational view of the sley, reed and the arrangement of the additional nozzle for supporting the air stream in the guide comb of a jet loom, the parts being shown in the position when the shed is open and at the moment of additional air streaming by the device of the invention.

As shown in FIG. 1, the guide comb 5 is tilted by adjustable link 3 acting upon the guide comb holder 4 towards the reed 8 at the moment when the shed is opened (such an arrangement and operation is more fully described in the Czechoslovak Patent Specification No. AO 180 260). In this position the reed 8 and its holder 1 and guide comb 5 are illustrated by heavy lines in FIG. 1. The position of the reed 1 and guide comb 5, at the moment of weft thread preparation, is illustrated by dash lines in FIG. 1.

The device for forming an additional air stream includes a distribution tube 6, which is firmly fastened onto the batten 2 by means of brackets 6*a* mounted between the reed 1 and harness 10. The distribution tube 6 is provided with at least one nozzle 7, although a plurality of nozzles 7 could be mounted along the guide comb 5, which is more effective. Each nozzle 7 is curved in its upper part 16 (FIG. 2) for the better penetration of the additional air stream into the warp ends 17. The slotted orifice 11 of the curved part 16 is longer than 10 millimeters and is several millimeters in width. The nozzles 7 are mounted on the distribution tube 6 in such a way that their slotted orifices 11 are directed towards the effective directing surfaces 9, 13 of the comb 5 which is formed on the rear part (right in FIG. 2) of the lamella 14. These directing surfaces 9, 13 are formed only on the rear parts 9 of lamellas 14 and are disposed oppositely to the slotted orifices 11 of the nozzles 7. The shape of the directing surfaces 9, 13 on the rear parts of the lamellas 14 resembles the shape of a turbine guide vane.

Figure 2:
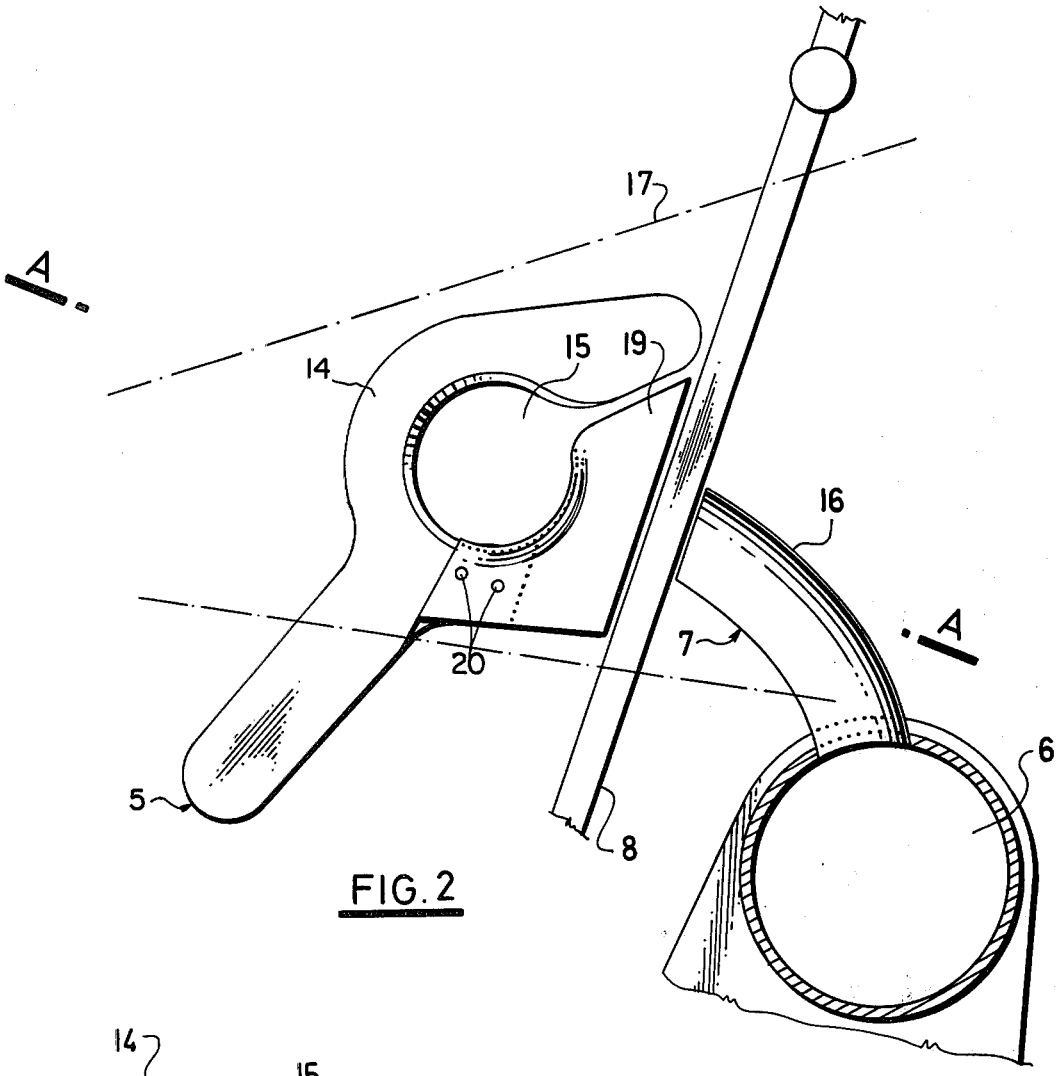
FIG. 2 is a detailed side elevational view of the comb and a part of the reed at an enlarged scale relative to the embodiment illustrated in FIG. 1, FIG. 2 illustrating the parts for additional air streaming in the guide comb and a part of the reed.
Figure 3:
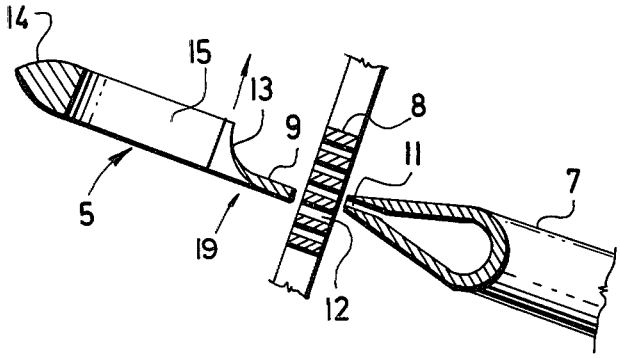
FIG. 3 is a section taken along the line A—A of FIG. 2.

As shown in FIG. 2, the rear part 9 of the directing surface is flat and is aligned with the axis of nozzle 7, the lower, forward part 13 of the directing surface being arcuate and merging smoothly with the forward end of part 9 of the directing surface. It will thus be seen that the surface 9,13 diverts the stream of air issuing from nozzle 7 through substantially a right angle so that when such stream leaves part 13 of the directing surface it travels as shown by the arrow in FIG. 2 in the direction of travel of the weft through the comb 5.

The device for forming an additional stream of air in a guiding comb as described above operates as follows:

From an unillustrated source of pressurized air, air is supplied by the distribution tube 6 to the nozzle 7 and is jetted out through the slotted orifice 11. When both the reed 1 and the guide comb 5 are in the full line weft insertion position of FIG. 1, air is streaming through the gaps 12 between the teeths 8 of the reed 1 and towards the directing surface 9, 13, by means of which it is directed into the weft insertion channel 15 of the comb 5, formed by the lamellas 14. The supporting stream of air is thus formed by the lamellas 14 and aids in the weft insertion into the opened shed formed by the warp ends 17. The flow of the additional supporting stream of air, formed in this way, is stopped during the beat-up motion, where both the reed 1 and guide comb 5 are in the position illustrated by dash lines in FIG. 1. Additional air streaming is renewed again when both the reed 1 and guide comb 5 return back into the weft insertion position, as illustrated by full lines in FIG. 1.

In the embodiment shown the directing surfaces 9,13 are formed upon a member 19 which, as shown, is made separate from the lamella 14 and is attached thereto by rivets 20.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In the method of operating an air jet loom having a guide comb, a reed, and means for forming a weft inserting supporting air stream which supplements a main weft supporting air stream in the guide comb, the improvement comprising directing a stream of air via at least one nozzle through said reed; and deflecting said stream of air to thereby direct it into the weft inserting direction in said guide comb.

2. In an air jet loom having a guide comb, a reed, and a device for forming in said guide comb a weft inserting supporting air stream supplemental to a main weft supporting air stream, the improvement comprising nozzle means for directing a stream of pressurized air through said reed substantially transversely relative to the longitudinal axis of said comb, and air stream deflecting means forming part of said comb for directing said transverse stream of air through said comb substantially in the direction of the longitudinal axis thereof.

* * * * *